US006907816B2

(12) United States Patent
Bubb et al.

(10) Patent No.: US 6,907,816 B2
(45) Date of Patent: Jun. 21, 2005

(54) SAFETY DIAPHRAGM FOR A DIAPHRAGM PUMP

(75) Inventors: Alexander Bubb, Schwetzingen (DE); Bernd Freissler, Dielheim (DE)

(73) Assignee: ProMinent Dosiertechnik GmbH (DE)

( * ) Notice: Subject to any disclaimer, the term of this patent is extended or adjusted under 35 U.S.C. 154(b) by 14 days.

(21) Appl. No.: 10/624,745

(22) Filed: Jul. 21, 2003

(65) Prior Publication Data

US 2004/0083883 A1 May 6, 2004

(30) Foreign Application Priority Data

Jul. 24, 2002 (DE) ..... 102 33 561

(51) Int. Cl.[7] ..... F01B 25/26
(52) U.S. Cl. ..... 92/5 R; 92/98 R
(58) Field of Search ..... 92/5 R, 92, 93, 92/96, 98 R, 99; 417/63

(56) References Cited

U.S. PATENT DOCUMENTS

| | | | | |
|---|---|---|---|---|
| 2,662,478 A | * | 12/1953 | Surre | 92/96 |
| 3,131,638 A | * | 5/1964 | Wilson et al. | 92/5 R |
| 3,661,060 A | * | 5/1972 | Bowen | 92/5 R |
| 5,074,757 A | * | 12/1991 | Horn | 417/63 |

FOREIGN PATENT DOCUMENTS

| | | | |
|---|---|---|---|
| DE | 3931516 | 4/1991 | F04B/43/02 |
| DE | 4027027 | 3/1992 | F04B/43/02 |
| EP | 0441681 A | 1/1991 | F04B/43/00 |
| EP | 0460386 | 12/1991 | F04B/43/00 |
| WO | WO92/19866 | 11/1992 | F04B/43/00 |

OTHER PUBLICATIONS

DE1800018—Jul. 8, 1969—Germany.
"Handbook of Engineering", pp. 24–25 Beitz, W. & Grote, K.–H.

* cited by examiner

*Primary Examiner*—Thomas E. Lazo
(74) *Attorney, Agent, or Firm*—Michael L. Dunn

(57) ABSTRACT

A safety diaphragm for a diaphragm pump, which makes it possible to detect a rupture of the diaphragm during operation or when at a standstill. The diaphragm has at least two diaphragm layers (1, 2) arranged lying one on top of the other The diaphragm has a clamping region (E) for fixing the diaphragm in a pump and has an adjacent operational region (A). The diaphragm layer (1, 2) are connected to each other so that they are sealed against penetration of liquid and/or gas between the diaphragm layers (1, 2). The diaphragm, in one section of the clamping region (E), has a sensor region (S) where the diaphragm layers (1, 2) are formed so that, in the case of an increase in pressure between the diaphragm layers (1, 2), the layers in sensor region (S) deform more easily than in the other sections of the diaphragm.

20 Claims, 4 Drawing Sheets

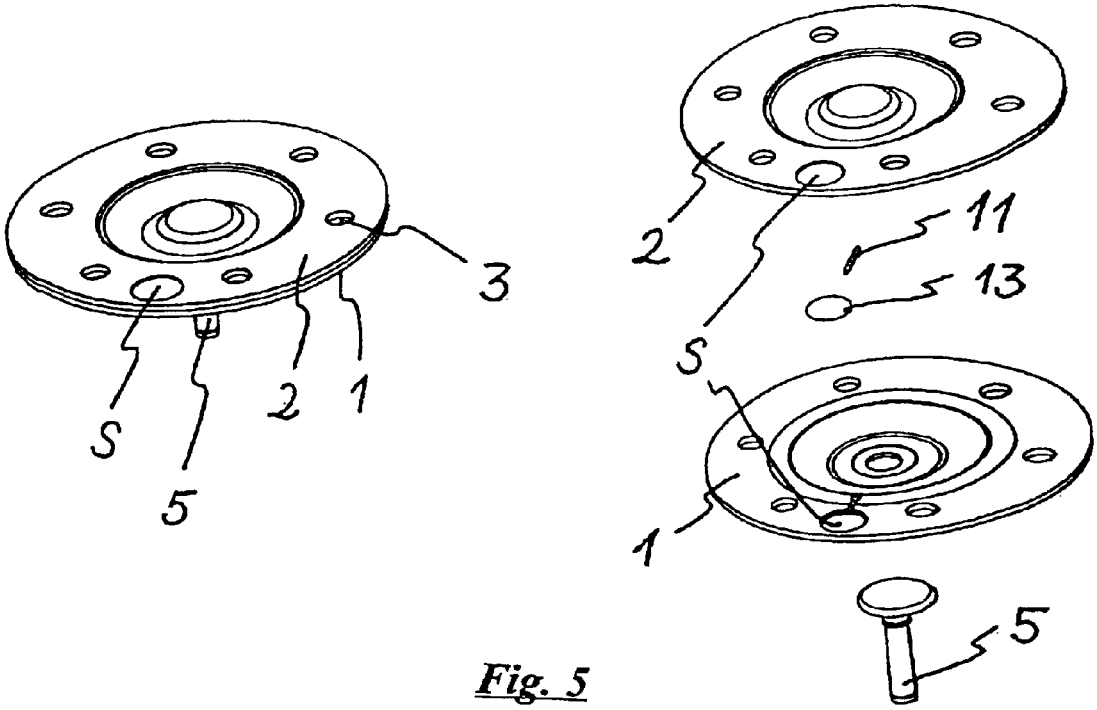
*Fig. 5*
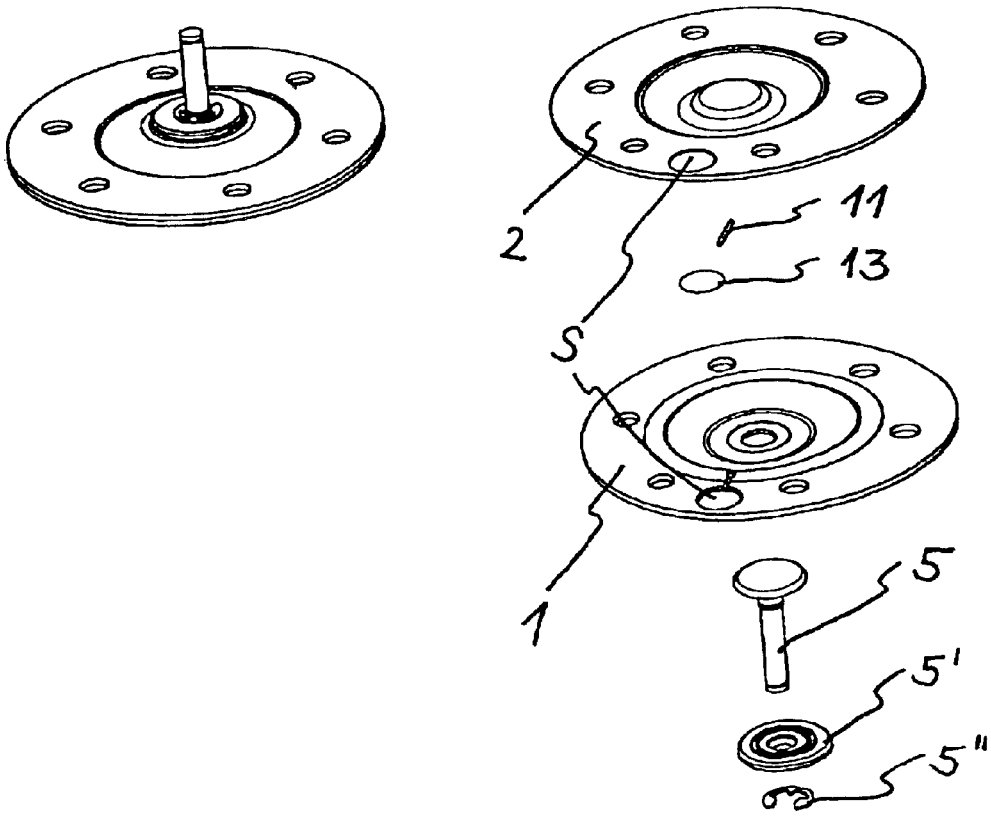

SAFETY DIAPHRAGM FOR A DIAPHRAGM PUMP

BACKGROUND OF THE INVENTION

The present invention relates to a safety diaphragm for a diaphragm pump, which makes it possible to detect a rupture of the diaphragm during operation or when at a standstill.

Piston diaphragm pumps with hydraulically deflected diaphragms are known, in which the diaphragm consists of at least three individual diaphragm layers lying one on top of the other. The space between the individual diaphragm layers is filled with a buffer fluid. The middle diaphragm layer is provided with slits, which are connected to a display device via a bore. In the event of a diaphragm rupture, in addition to the buffer fluid, pumped medium or hydraulic fluid enters the space between the individual diaphragm layers, and acts upon the display device, signaling the diaphragm rupture. In this case mixing occurs between pumped medium/hydraulic fluid and buffer fluid, which is to be avoided, especially when delivering corrosive fluids.

In other known diaphragm pumps, in particular in the case of mechanically deflected diaphragm pumps, a pressure line leads from a space between different individual diaphragm layers from the pump housing out to a display device. These pressure lines, in particular outside the pump housing, are very susceptible to being bent or crushed, so that with time they start to leak. In the case of these known diaphragm pumps, it is not a diaphragm itself that is monitored with respect to a diaphragm rupture, but the space between different individual diaphragms, which although connected with one another, are otherwise separate from one another and do not represent an hermetically sealed unit.

In the case of diaphragm pumps, a distinction is made between mechanically deflected and hydraulically deflected diaphragm delivery units. To deliver a fluid by means of a diaphragm pump, a piston displacement based on the stroke movement of an operational region of the diaphragm is passed on to the fluid to be delivered. In the case of mechanically deflected diaphragms, the operational region of the diaphragm is deflected by means of an actuating rod perpendicular to the diaphragm surface. Due to the deflection of the diaphragm by means of the actuating rod, alternating compression and suction movements are carried out (compression stroke and suction stroke). In the case of a hydraulically deflected diaphragm, compression and suction strokes are carried out by a hydraulic positive pressure and negative pressure of a hydraulic fluid on the operational region of the diaphragm. The integrated actuating rod supports the suction stroke by means of a return spring.

The objective of the present invention is now to provide a safety diaphragm for diaphragm pumps, which allows safe detection of rupture sites in the diaphragm, functions without a buffer between different diaphragm layers, is simple in construction, requires low maintenance expenditure, prevents mixing of pumped medium/hydraulic fluid, detects a diaphragm rupture before pumped medium/hydraulic fluid can penetrate out through the diaphragm, and does not in any case have to be replaced immediately when a rupture occurs in the diaphragm, but optionally allows emergency operation until the next diaphragm change.

BRIEF DESCRIPTION OF THE INVENTION

The objectives of the invention are achieved by a safety diaphragm for a diaphragm pump with at least two diaphragm layers arranged lying one on top of the other, usually with an essentially circular periphery. The two diaphragm layers (1, 2) each have opposing inner and outer surfaces and a peripheral edge and are arranged so that the inner surfaces of the diaphragm layers are adjacent each other. The diaphragm from the peripheral edge towards a center has a clamping region (E) running in a peripheral direction for fixing the diaphragm in a pump and has an adjacent operational region (A) from the clamping region (E) toward the center. The diaphragm layers (1, 2) are connected to each other so that they are sealed against penetration of liquid and/or gas between the diaphragm layers and so that there is atmospheric or subatmospheric pressure between the diaphragm layers (1, 2). The diaphragm in one section of the clamping region (E) has a sensor region (S) where the diaphragm layers (1, 2) are formed so that, in the case of an increase in pressure between the diaphragm layers (1, 2), with an increase in the distance between the diaphragm layers, the layers in sensor region (S) deform more easily than in the other sections of the diaphragm. A detector is provided for detecting increased deformation in the sensor region due to increased pressure between the layers indicating diaphragm failure.

BRIEF DESCRIPTION OF THE DRAWINGS

FIG. 5 shows an exploded representation of the safety diaphragm according to the invention in FIGS. 1 to 4.

DETAILED DESCRIPTION OF THE INVENTION

Figure 1:
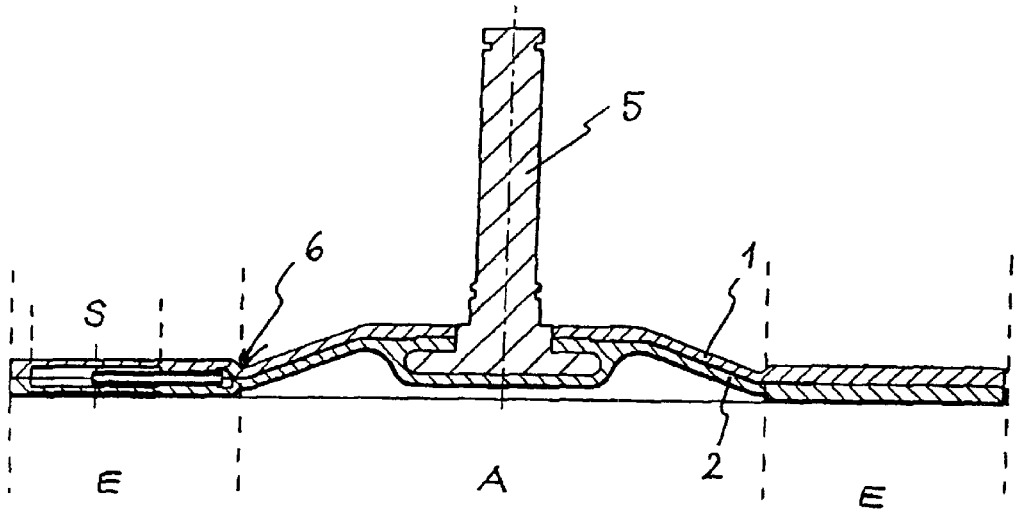
FIG. 1 shows a cross-section of a safety diaphragm according to the invention along the line C—C in FIG. 4.
Figure 2:
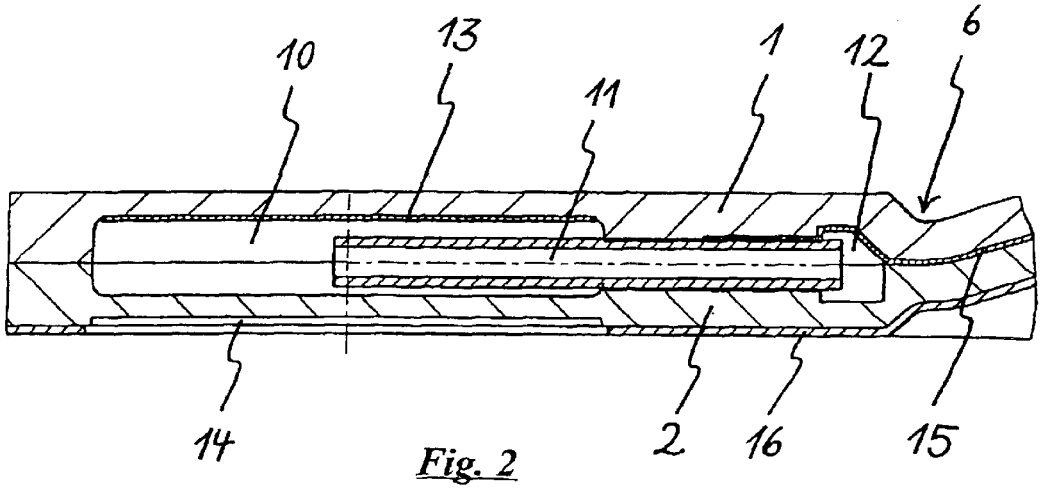
FIG. 2 is an enlarged representation of the safety region of the diaphragm in FIG. 1.
Figure 3:
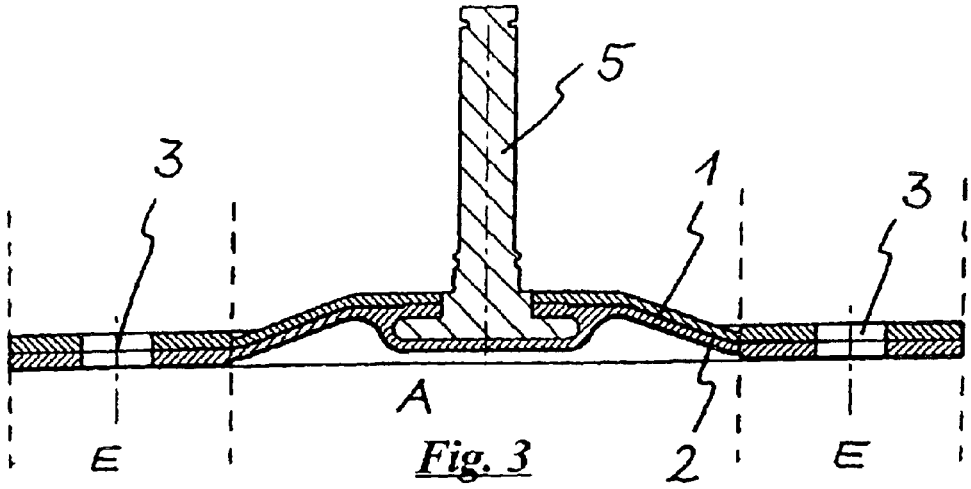
FIG. 3 shows a cross-section of the safety diaphragm according to the invention along the line D—D in FIG. 4.

In the case of the safety diaphragm according to the invention, an actuating rod is preferably arranged centered in the operational region of preferably essentially circular diaphragm layers and the rod is securely connected to them. The operational region of the diaphragm is the section which moves up and down with compression and suction movement. The operational region extends outwards from the geometric center of the diaphragm layers. Adjacent to and to the outside of the operational region of the diaphragm lies a clamping region, with which the diaphragm according to the invention is fixed in a pump. The clamping region of the diaphragm according to the invention, in a preferred version, has openings passing perpendicularly through the diaphragm layers, for bolts to be passed through to fix the diaphragm and for precise positioning. Openings are however not absolutely necessary. The diaphragm can also be fixed in the pump housing by clamping.

The safety diaphragm according to the invention consists of at least two, preferably exactly two, diaphragm layers arranged lying one on top of the other, i.e., so that their inner surfaces are proximate each other. The diaphragm layers are connected to each other in sealed manner at all edge regions, e.g., at least at the peripheral edge, where liquid or gas could otherwise penetrate. The diaphragm layers arranged lying one on top of the other are thus, at least at their peripheral edge and, if present, at openings passing through the clamping region and in the center at the actuating rod, connected with each other in liquid-tight and gas-tight manner. The other surfaces, facing one another, of the diaphragm layers arranged lying one on top of the other are not necessarily firmly connected to one another. They preferably lie one on top of the other with no firm connection. Alternatively the inner surfaces facing one another can be firmly connected to one another e.g., by means of vulcanization or adhesive technique in sections or at points. According to the invention there is atmospheric or subatmospheric pressure between the diaphragm layers, so that the inner surfaces of the diaphragm layers facing one another lie flat one on top of the other during operation.

In the case of damage to one of the diaphragm layers during operation, pumped medium or hydraulic fluid penetrates into the space between the diaphragm layers so that the pressure inside this space rises from atmospheric or subatmospheric pressure to the pressure in the pumped medium or hydraulic fluid. Because the diaphragm layers are not firmly connected with one another throughout their surfaces, the pressure/penetrating liquid between the diaphragm layers can spread out as far as a sensor region of the diaphragm. The section of the sensor region of the diaphragm according to the invention is formed so that the diaphragm layers in this section offer less resistance to the increased pressure and deform more easily than the diaphragm layers in the other sections of the diaphragm. In the case of a diaphragm rupture and accompanying increase in pressure between the diaphragm layers, the section of the sensor region is pushed apart with increasing distance between the opposite surfaces of the diaphragm layers. In order to achieve this, in a preferred version of the safety diaphragm according to the invention, the diaphragm layers in the section of the sensor region are formed with a lower material thickness than in the other sections of the diaphragm. In an alternative version the material of the diaphragm layers in the section of the sensor region has a higher elasticity than in the other sections of the diaphragm. Both features can also be achieved simultaneously. The detection of a diaphragm rupture takes place according to the invention by means of a sensor, which detects the expansion or increase in the distance between the diaphragm layers due to the pressure increase between the diaphragm layers. In a particularly preferred version of the invention a sensor is arranged for this purpose on the sensor region on an external surface of the diaphragm layers such that the sensor responds to a deformation of the diaphragm layers in the section of the sensor region, i.e., detecting the stretching of the diaphragm in the sensor region, mechanically or otherwise, and passing this information on in the form of a signal. The section of the diaphragm in the sensor region opposite the sensor expediently adjoins a facing surface so that in the case of a rupture of the diaphragm, the diaphragm in the sensor region stretches in one direction only, i.e. in the direction of the sensor.

In a particularly preferred version of the safety diaphragm according to the invention the individual diaphragm layers are formed in one piece by means of plastic molding, vulcanization or adhesive techniques as a self-contained and hermetically sealed unit.

In a further particularly preferred version of the safety diaphragm according to the invention, at least the diaphragm layer coming into contact with the medium to be delivered is covered with a coating or film resistant to the medium to be delivered. A coating with polytetrafluoroethylene (PTFE) has proved to be particularly advantageous.

In yet a further advantageous version of the invention, at least one of the inner surfaces, facing one another, is covered with a coating or film, preferably a PTFE layer. This guarantees that the diaphragm layers arranged lying one on top of the other do not fuse together, stick or otherwise adhere firmly to each other, which would disturb or prevent the spread of the pressure increase in the case of a diaphragm rupture during operation.

During the pump operation, the operational region of the safety diaphragm according to the invention is moved alternately up and down with high frequency, whilst the clamping region remains in a fixed position. The transition from clamping region to operational region, at which the operational region is articulated to the clamping region, is therefore exposed to particularly high mechanical stresses. The sensor region, in which the material of the diaphragm layers, in a preferred version of the invention, has a lower material thickness, therefore expediently does not extend directly to the transition between the clamping region and operational region of the diaphragm. A weakening of the material in this transition region would result in more rapid wear of the diaphragm and more frequent replacement. In order nevertheless to guarantee a reliable spread of an increased pressure due to a diaphragm rupture, in a preferred version of the safety diaphragm according to the invention a connecting channel is provided, which extends from the transition between operational region and clamping region to sensor region. Particularly preferably, this channel is formed as a pressure pipe. The pressure pipe prevents the diaphragm layers in this section of the clamping region from being squeezed tightly together, and guarantees a reliable pressure spread from the transition between clamping region and operational region into the sensor region. It is further preferred, that a cavity is formed between the diaphragm layers close to the transition region between clamping region and operational region and preferably one end of the pressure pipe extends into this cavity. This guarantees that the opening of the pressure pipe cannot be closed by the material of the diaphragm layers pressed together in the clamping region. The cavity close to the transition region between clamping region and operational region is expediently produced in that the material of the diaphragm layers there has a lower material thickness than in the other sections of the diaphragm. The material thickness in this region should however be selected so that a sufficient mechanical stability remains guaranteed at the transition between clamping region and operational region.

Further advantages, features and versions of the safety diaphragm according to the invention are now described with reference to the following embodiments and accompanying figures.

The safety diaphragm according to the invention in FIGS. 1 to 5 is made up of two diaphragm layers 1 and 2 having inner surfaces proximate each other, e.g., arranged lying one on top of the other. Viewed from above, the diaphragm layers 1 and 2 preferably have a circular periphery. An operational region A extends from a center of the diaphragm layers 1 and 2 to a distance which in a preferred embodiment corresponds approximately to half the radius of the diaphragm layers. This operational region A is bordered by the clamping region E, which extends from the operational region to the peripheral edge of the diaphragm layers.

An actuating rod 5 for the mechanical deflection of the operational region of the safety diaphragm and/or for supporting the suction stroke of a hydraulically driven safety diaphragm is firmly connected with the diaphragm layers in the center of the operational region of the diaphragm. In a preferred embodiment, the actuating rod 5 is essentially stamp-shaped, and has an essentially cylindrical guide rod with fixing elements for engagement with a device for actuating the actuating rod. At the end of the essentially cylindrical rod connected with the diaphragm layers, the actuating rod 5 has an essentially circular disc-shaped enlargement, which for the fixing of the actuating rod to the diaphragm layers, is held to the diaphragm layers 1 and 2 in form-locking manner by the diaphragm material. For fixing and/or support of the connection between the diaphragm layers 1 and 2 in the core region, which in the case of a diaphragm rupture and as a result of the pressure increase occurring between the diaphragm layers is subjected to considerable tensile stresses, a supporting disc 5' can additionally be provided. A retaining ring 5" may hold the supporting disc 5' on the actuating rod 5 in position.

In the clamping region E the diaphragm layers 6 have fixing bores 3 which are provided for corresponding fixing bolts to pass through, to fix the diaphragm in a pump housing.

The diaphragm layers of the version of the safety diaphragm according to the invention represented in FIGS. 1 to 5 are firmly connected to one another at all the edge regions against penetration of liquid and/or gas, i.e., at the peripheral edges of the circular diaphragm layers, at the edges of the fixing bores 3 and at the edges of the opening for the actuating rod 5 to pass through.

Figure 4:
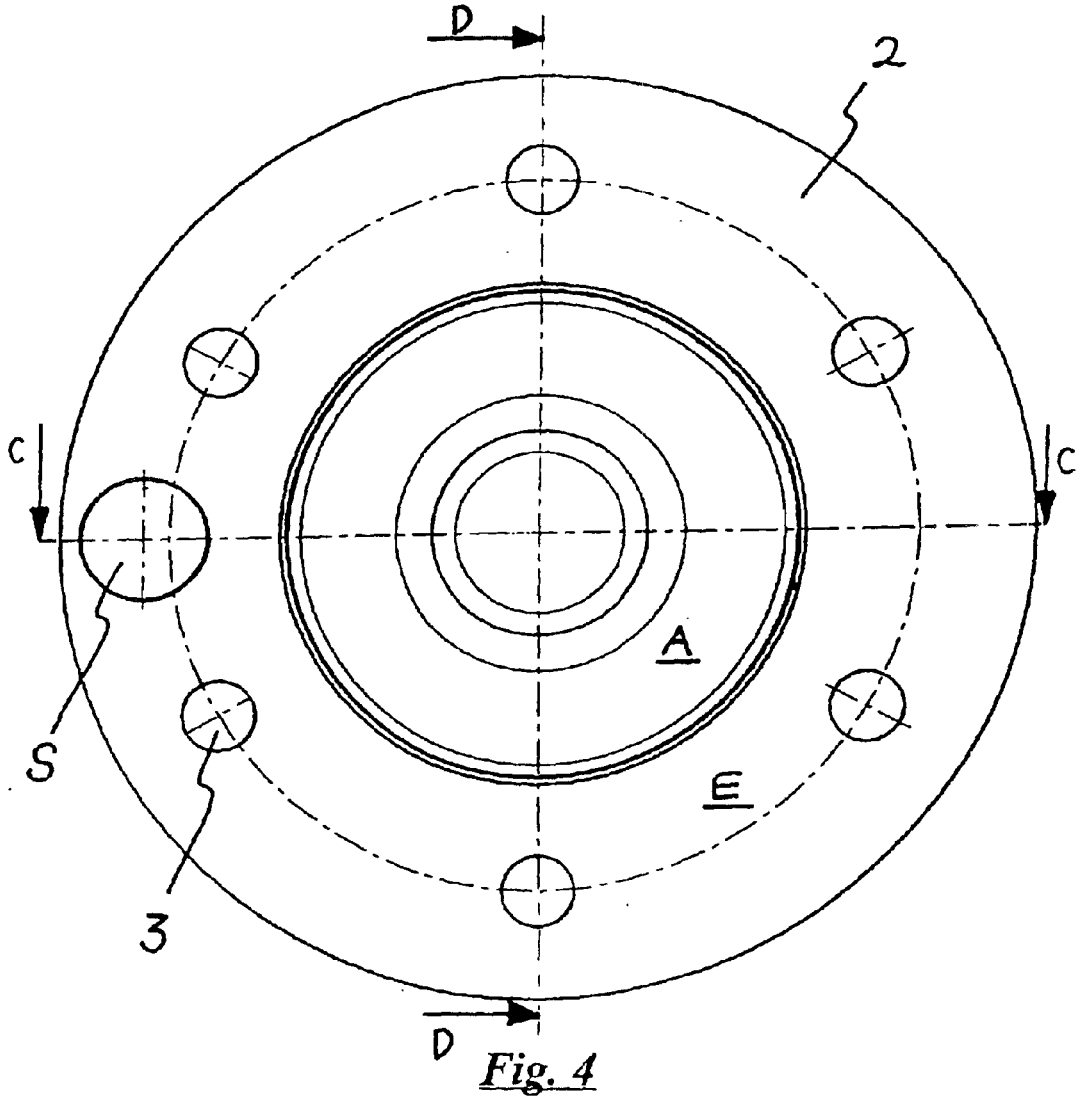
FIG. 4 shows a diagrammatic representation of the safety diaphragm according to the invention in FIGS. 1 to 3, from below.

The embodiment of the safety diaphragm according to the invention as shown in FIGS. 1 to 5 has a sensor region S in the clamping region E. However it is clear that the safety diaphragm according to the invention can also comprise two or more such sensor regions. The top view in FIG. 4 shows that the sensor region S in the preferred version of the safety diaphragm according to the invention represented is an essentially circular region in the clamping region of the diaphragm. The sensor region S can however also have other shapes viewed from above, such as an oval or polygonal shape.

In the version of the safety diaphragm according to the embodiment represented, the material of the diaphragm layers 1 and 2 in the sensor region S is formed with a lower material thickness than in the other sections of the diaphragm. This guarantees that the diaphragm layers in the section of the sensor region S, in the case of an increase in the pressure between the diaphragm layers 1 and 2 due to a diaphragm rupture, deform more easily in the section of the sensor region than in the other sections of the diaphragm. In the case of this deformation, the distance between the diaphragm layers in the sensor region is increased and a pressure exerted on a corresponding sensor, which then indicates the diaphragm rupture. Due to the lower material thickness of the diaphragm layers 1 and 2 in the sensor region S, a cavity 10 is provided in the sensor region between the diaphragm layers. A pressure pipe 11 extends from this cavity 10 in the sensor region S through a section of the clamping region with higher material thickness to a further cavity 12, which is formed close to the transition 6 between clamping region E and operational region A. The pressure pipe 11 guarantees a reliable spread of increased pressure between the diaphragm layers, arising due to a diaphragm rupture and the penetration of liquid or gas between the diaphragm layers 1 and 2. The provision of the cavity 12 close to the transition 6 guarantees that the end of the pressure pipe 11 opening into this cavity 12 is not closed by the material of the diaphragm, which is squeezed together in the clamping region due to the clamping of the diaphragm in a pump housing. Instead of a pressure pipe a piece of fabric or a molded part with channels passing through can be used.

With the exception of the firmly connected edge regions described above, the diaphragm layers 1 and 2 preferably lie one on top of the other without any firm connection. Between the diaphragm layers 1 and 2 there is atmospheric or subatmospheric pressure, so that the diaphragm layers, under normal operating conditions, i.e., when no diaphragm rupture is present, are held in close contact with each other.

In the preferred version of the safety diaphragm according to the invention according to FIGS. 1 and 5 the underside of the diaphragm layer 2, which faces the pumped medium, is coated with a PTFE film. The material of the diaphragm layer is thus protected from attack by corrosive pumped media. The provision of this protective PTFE film 16 makes it possible to select the material of the diaphragm layers according to the mechanical stress requirements for pumps, without having to compromise the chemical resistance. Instead of the PTFE film, any other chemical and/or mechanical material resistant to the pumped medium can also be used. Examples of suitable protective films are known to the person skilled in the art in the field.

The safety diaphragm according to the invention according to FIGS. 1 and 5 moreover has a PTFE film 15 between the diaphragm layers 1 and 2. This PTFE film 15 prevents the material of the diaphragm layers, e.g. due to considerable heat development during operation, from sticking together and thus preventing a spread of pressure between the diaphragm layers in the case of a diaphragm rupture. Moreover, the diaphragm layer 1 in the sensor region S has a further PTFE disc 13, which prevents sticking of the diaphragm layers in the sensor region.

In the sensor region S, on the outside of the diaphragm layer 2 facing the sensor, an exterior sensor contact surface 14 is provided, on which a sensor is brought into contact with the sensor region S of the safety diaphragm. In the case of a diaphragm rupture and an expansion or increase in the distance between the diaphragm layers in the sensor region S, the material of the lower diaphragm layer 2 curves outwards together with the sensor contact surface 14 and actuates the sensor. The opposite section of the diaphragm layer 1 in the sensor region S, on which, in the version represented, no sensor is provided, preferably lies against a solid opposite surface. This guarantees that the whole expansion of the diaphragm layers in the sensor region S extends fully in the direction of the sensor arranged on the lower diaphragm layer 2.

Figure 6:
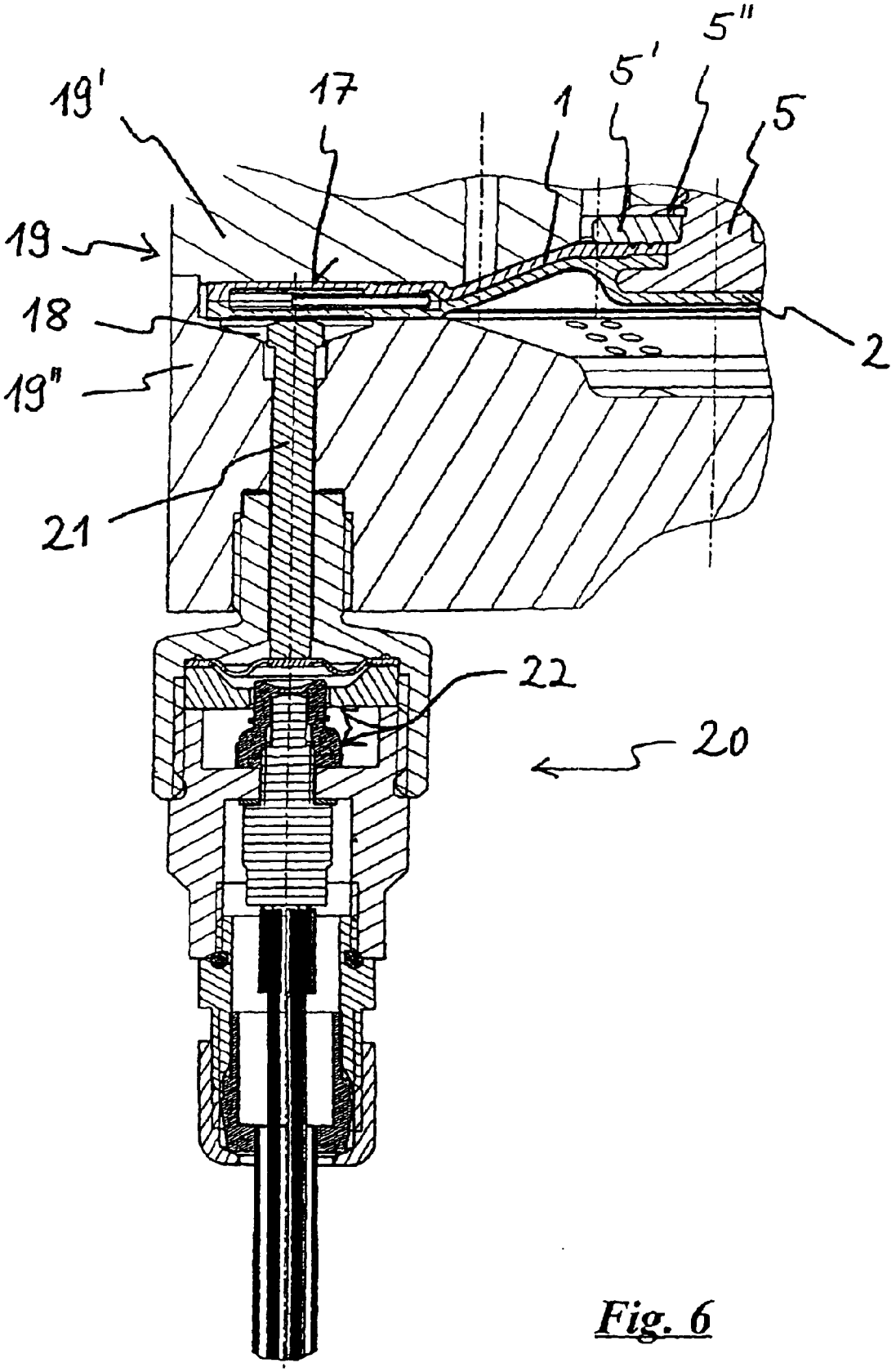
FIG. 6 shows a diagrammatic representation of a sensor for the safety diaphragm according to the invention, in cross-section.

FIG. 6 shows a cross-sectional representation of the diaphragm according to the invention illustrated in FIGS. 1 to 5 in a pump housing 19 with a sensor 20 for detecting an expansion of the diaphragm layers in the sensor region S in the case of a diaphragm rupture.

The clamping region E of the diaphragm according to the invention is firmly clamped in the pump housing 19 between housing parts 19' and 19". The pump housing 19 has a spherical expansion cavity 18 in the housing section 19", in the section in which, in the case of a diaphragm being installed, the sensor region S is arranged. Sensor 20 is arranged on housing part 19". An actuating piston 21 of the sensor 20 extends through a bore in the housing section 19" in expansion cavity 18 and lies against the sensor contact surface 14 in the sensor region of the safety diaphragm. On an opposite side of the diaphragm, the housing part 19' of the pump housing 19 has a solid opposite surface 17, which prevents an expansion of the sensor region in the direction of the housing part 19'. An expansion of the diaphragm layers, in the case of a diaphragm rupture and a pressure increase between the diaphragm layers 1 and 2 in the sensor region S, thus takes place exclusively in the direction of the sensor into the expansion cavity 18 provided for this purpose, under exertion of a pressure on the actuating piston 21, said actuating piston 21 being moved in the direction of the sensor, and actuating a switch 22, which in turn is connected to a display device (not represented) for indicating a diaphragm rupture.

Independent of whether a rupture of the diaphragm layer 2 on the side of the pumped medium occurs, or of the diaphragm layer 1 on the opposite side, the safety diaphragm according to the invention can still continue to be used for a certain period in "emergency operation", as the respective unbroken diaphragm layer prevents pumped medium or hydraulic fluid from passing through the whole diaphragm. The safety diaphragm according to the invention guarantees that a diaphragm rupture is detected before liquid can pass through the diaphragm and contaminate either the pumped medium or an optionally provided hydraulic fluid. The safety diaphragm according to the invention can be produced like conventional diaphragms with respect to its form and external dimensions, so that they can be used without considerable additional expenditure in existing pump housings. Only one additional bore has to be provided in the pump housing for the insertion of a sensor. The safety diaphragm according to the invention also requires considerably lower maintenance expenditure than known safety diaphragms, which are intended to indicate a diaphragm rupture.

What is claimed is:

1. A safety diaphragm for a diaphragm pump comprising at least two diaphragm layers (1, 2) each having opposing inner and outer surfaces and a peripheral edge and arranged so that the inner surfaces of the diaphragm layers are adjacent each other, said diaphragm from the peripheral edge towards a center having a clamping region (E) running in a peripheral direction for fixing the diaphragm in a pump and having an adjacent operational region (A) from the clamping region (E) toward the center; said diaphragm layers (1, 2) being connected to each other so that they are sealed against penetration of liquid and/or gas between the diaphragm layers and so that there is atmospheric or subatmospheric pressure between the diaphragm layers (1, 2) and so that the diaphragm layers remain sealed to each other in the area of the clamping region, against penetration of liquid and/or gas between the layers in the area of the clamping region in the event of rupture of one of the layers; said diaphragm in one section of the clamping region (E) comprising a sensor region (S) where the diaphragm layers (1, 2) are formed to deform more easily than in the other sections of the diaphragm so that an increase in pressure between the diaphragm layers (1, 2), due to failure of a diaphragm layer, causes a detectable increase in distance between the diaphragm layers in sensor region (S).

2. The safety diaphragm of claim 1 wherein the peripheral edge is essentially circular.

3. A safety diaphragm according to claim 2 wherein the diaphragm layers (1, 2) in the section of the sensor region (S) have lower material thickness than in the other sections of the diaphragm.

4. A safety diaphragm according to claim 2 wherein the diaphragm layers (1, 2) in the section of the sensor region (S) have higher elasticity than in the other sections of the diaphragm.

5. A safety diaphragm according to claim 2 wherein the inner surfaces facing one another of the diaphragm layers (1, 2) in the section of the sensor region (S) are at a distance from one another, forming a cavity.

6. A safety diaphragm according to claim 2 wherein the diaphragm, in the center of the operational region, has an actuating rod (5), with which the diaphragm layers (1, 2) are preferably tightly connected in form-locking manner.

7. A safety diaphragm according to claim 1 wherein a sensor is arranged within the sensor region (S) of the diaphragm, which sensor responds to a deformation of the diaphragm layers (1, 2) in the section of the sensor region (S).

8. A safety diaphragm according to claim 7 wherein the diaphragm layers (1, 2) in the section of the sensor region (S) have lower material thickness than in the other sections of the diaphragm.

9. A safety diaphragm according to claim 7 wherein the diaphragm layers (1, 2) in the section of the sensor region (S) have higher elasticity than in the other sections of the diaphragm.

10. A safety diaphragm according to claim 7 wherein the inner surfaces facing one another of the diaphragm layers (1, 2) in the section of the sensor region (S) are at a distance from one another, forming a cavity.

11. A safety diaphragm according to claim 7 wherein the diaphragm, in the center of the operational region, has an actuating rod (5), with which the diaphragm layers (1, 2) are preferably tightly connected in form-locking manner.

12. A safety diaphragm according to claim 1 wherein the diaphragm layers (1, 2) in the section of the sensor region (S) have lower material thickness than in the other sections of the diaphragm.

13. A safety diaphragm according to claim 12 wherein the diaphragm layers (1, 2) in the section of the sensor region (S) have higher elasticity than in the other sections of the diaphragm.

14. A safety diaphragm according to claim 12 wherein the inner surfaces facing one another of the diaphragm layers (1, 2) in the section of the sensor region (S) are at a distance from one another, forming a cavity.

15. A safety diaphragm according to claim 12 wherein the diaphragm, in the center of the operational region, has an actuating rod (5), with which the diaphragm layers (1, 2) are preferably tightly connected in form-locking manner.

16. A safety diaphragm according to claim 15 wherein a supporting disc (5') is provided on the actuating rod (5).

17. A safety diaphragm according to claim 1 wherein the diaphragm layers (1, 2) in the section of the sensor region (S) have higher elasticity than in the other sections of the diaphragm.

18. A safety diaphragm according to claim 1 wherein the inner surfaces facing one another of the diaphragm layers (1, 2) in the section of the sensor region (S) are at a distance from one another, forming a cavity.

19. A safety diaphragm according to claim 1 wherein the diaphragm, in the center of the operational region, has an actuating rod (5), with which the diaphragm layers (1, 2) are preferably tightly connected in form-locking manner.

20. The safety diaphragm of claim 1 where the inner surfaces of the diaphragm layers in an area near the peripheral edge are connected to each other to form a one piece self-contained hermetically sealed unit.

* * * * *